US007748804B2

(12) United States Patent
Lim et al.

(10) Patent No.: US 7,748,804 B2
(45) Date of Patent: Jul. 6, 2010

(54) DRAWER TYPE RECEIVING DEVICE OF A REFRIGERATOR

(75) Inventors: Jae Hoon Lim, Suwon-si (KR); Dae Yeop Park, Gwangju (KR); Myung Ju Sim, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 175 days.

(21) Appl. No.: 11/984,213

(22) Filed: Nov. 14, 2007

(65) Prior Publication Data

US 2008/0202146 A1 Aug. 28, 2008

(30) Foreign Application Priority Data

Feb. 26, 2007 (KR) ..... 10-2007-0019184

(51) Int. Cl.
*A47B 96/04* (2006.01)

(52) U.S. Cl. ..... 312/404; 312/408; 312/334.23; 108/108

(58) Field of Classification Search ..... 312/404, 312/408, 108; 211/126.15; 403/13, 361
See application file for complete search history.

(56) References Cited

U.S. PATENT DOCUMENTS 2,641,374 A * 6/1953 Der Yuen ..... 215/10
3,565,504 A * 2/1971 Brown ..... 312/270.3
5,228,764 A * 7/1993 Cherry et al. ..... 312/408
5,406,894 A * 4/1995 Herrmann et al. ..... 108/108
5,524,981 A * 6/1996 Herrmann et al. ..... 312/408
5,944,201 A * 8/1999 Babboni et al. ..... 211/151
6,769,750 B2 * 8/2004 Hughes et al. ..... 312/265.5
2005/0011420 A1 * 1/2005 Costa et al. ..... 108/108
2005/0093409 A1 * 5/2005 Vardon ..... 312/408
2005/0184630 A1 * 8/2005 Bonanno et al. ..... 312/408

FOREIGN PATENT DOCUMENTS

KR 2007-0019219 2/2007

* cited by examiner

*Primary Examiner*—Janet M Wilkens
*Assistant Examiner*—Matthew W Ing
(74) *Attorney, Agent, or Firm*—Staas & Halsey LLP

(57) ABSTRACT

A refrigerator which provides an improved installation structure of a receiving device disposed in a storage chamber such that the receiving device can be stably supported in the storage chamber and easily mounted on and separated from the storage chamber. The refrigerator includes a shelf fixing structure which fixes a shelf to the storage chamber. The shelf fixing structure includes an engaging protrusion formed on a lower surface of the shelf at one side of the shelf, a stepped surface formed at the other side of the shelf, a restriction groove formed at a position corresponding to the engaging protrusion to restrict the engaging protrusion, and a restriction portion formed at a position corresponding to the stepped surface to restrict the stepped surface.

12 Claims, 5 Drawing Sheets

DRAWER TYPE RECEIVING DEVICE OF A REFRIGERATOR

CROSS-REFERENCE TO RELATED APPLICATIONS

This application claims the benefit of Korean Patent Application No. 2007-0019184, filed on Feb. 26, 2007 in the Korean Intellectual Property Office, the disclosure of which is incorporated herein by reference.

BACKGROUND

1. Field

The present invention relates to a refrigerator, and more particularly to a refrigerator which provides an improved installation structure of a receiving device disposed in a storage chamber.

2. Description of the Related Art

A refrigerator is an apparatus which supplies cool air generated by a refrigeration cycle to a storage chamber to maintain freshness of various food products for a long period of time. Generally, the refrigerator includes a compressor, a condenser, an expansion valve and an evaporator. The refrigerator supplies cool air to the storage chamber, that is, a freezing chamber and a cooling chamber, using heat transfer according to phase change of a coolant.

A plurality of shelves is disposed in the storage chamber of the refrigerator to store food products thereon. A drawer type receiving device may be disposed in the storage chamber to freshly store food products such as vegetables, fruit, meat and fish.

Korean Laid-open Patent Publication No. 2007-19219 discloses an example of a refrigerator including such a receiving device. A conventional refrigerator disclosed in Korean Laid-open Patent Publication No. 2007-19219 includes a vegetable box with an upper portion opened, and a shelf, that is, a vegetable box cover installed to cover the upper portion of the vegetable box and separate the vegetable box from the cooling chamber. A guide rail having a guider for stably loading the vegetable box is disposed on the lower surface of the vegetable box cover. The vegetable box is extracted outward and retracted inward while sliding along the guide rail.

However, in the above-mentioned receiving device, if the vegetable box cover is unstably mounted on the storage chamber, when the vegetable box is extracted and retracted or when products disposed on the vegetable box cover are loaded and unloaded, the vegetable box cover moves with the vegetable box or the products. When the vegetable box cover moves, it may not stably support the products disposed on the vegetable box cover. Accordingly, it may cause a feeling of uneasiness in a user. Further, in an even worse case, the vegetable box cover may be separated from the storage chamber to the outside.

On the other hand, the vegetable box cover may be completely fixed to an inner portion of the storage chamber in order to stably mount the vegetable box cover. In this case, however, when the inner portion of the storage chamber or the vegetable box cover is cleaned, it is not easy to separate the vegetable box cover, thereby causing inconvenience to the user.

SUMMARY

The present invention has been made in order to solve the above problems. It is an aspect of the invention to provide a refrigerator which provides an improved installation structure of a receiving device disposed in a storage chamber such that the receiving device can be stably supported in the storage chamber and easily mounted on and separated from the storage chamber.

In accordance with an aspect of the invention, there is provided a refrigerator including a storage chamber; a shelf installed in the storage chamber; and a shelf fixing structure which fixes the shelf to the storage chamber, the shelf fixing structure including an engaging protrusion formed on a lower surface of the shelf at one side of the shelf, a stepped surface formed at the other side of the shelf, a restriction groove formed at a position corresponding to the engaging protrusion to restrict the engaging protrusion, and a restriction portion formed at a position corresponding to the stepped surface to restrict the stepped surface.

The engaging protrusion may formed at a front portion of the shelf and the stepped surface may be formed at a rear portion of the shelf.

The refrigerator according to the present invention may further include a support member installed in the storage chamber to support the shelf; and a receiving container positioned under the shelf and slidably installed on the support member, where the restriction groove and the restriction portion are formed in the support member.

The engaging protrusion may be formed on an outer frame of the shelf as one body, and the stepped surface may be formed at a rear edge portion of the shelf.

In accordance with another aspect of the invention, there is provided a refrigerator including a storage chamber; a support member installed on a side surface of the storage chamber; a shelf positioned on the support member to cover a receiving container positioned under the shelf; a first restriction portion which restricts an upper surface of the shelf to prevent vertical movement of the shelf; an engaging portion formed on the shelf; and a second restriction portion formed on the support member to restrict the engaging portion to prevent forward-backward and left-right movement of the shelf.

The first restriction portion and the support member may be formed as one body. The support member may include an extended portion extended upward from an upper surface of the support member and a bent portion bent from the extended portion to cover a peripheral portion of the upper surface of the shelf.

The upper surface of the shelf may include a stepped surface which is inserted and fitted to a lower portion of the bent portion.

The engaging portion may include an engaging protrusion protruded from the shelf toward the upper surface of the support member, and the second restriction portion may include a restriction groove formed at a position corresponding to the engaging protrusion in the support member to receive the engaging protrusion.

The second restriction portion may further include a restriction rib crossing the restriction groove, and the engaging portion may further include an engaging groove which engages with the restriction rib.

The first restriction portion may be positioned to restrict a rear portion of the shelf and the second restriction portion may be positioned to restrict a front portion of the shelf.

In accordance with yet another aspect of the invention, there is provided a refrigerator including a support member having a rail part and a support surface disposed above the rail part; a receiving container slidably installed on the rail part; and a shelf positioned on the support surface to cover an upper portion of the receiving container, wherein the shelf includes an engaging portion protruded toward the support surface, and the support member includes a first restriction portion formed to cover a portion of a side surface and a portion of an upper surface of the shelf to prevent vertical movement of the shelf, and a second restriction portion which engages with the engaging portion to prevent forward-backward and left-right movement of the shelf.

The first restriction portion may include an extended portion extended upward from the support surface and a bent portion bent from the extended portion toward the upper surface of the shelf to cover the upper surface of the shelf.

The upper surface of the shelf may include a stepped surface which is inserted and fitted to a lower portion of the bent portion. The side surface of the shelf may include a stepped surface which is inserted and fitted to an inner side portion of the extended portion.

The second restriction portion may include a restriction groove formed at a position corresponding to the engaging portion on the support surface to receive the engaging portion.

The second restriction portion may further include a restriction rib crossing the restriction groove in a diagonal direction, and the engaging portion may include an engaging groove which engages with the restriction rib.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE EMBODIMENTS

Figure 1:
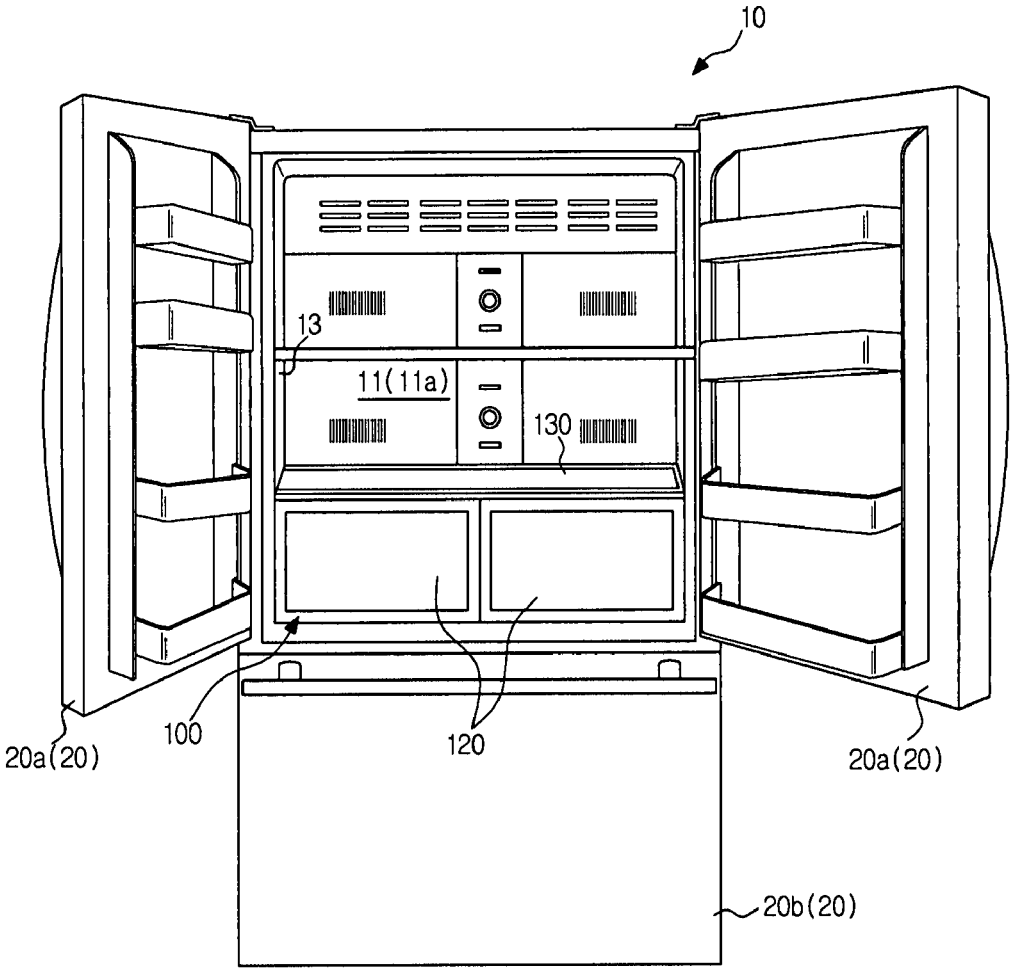
FIG. 1 is a front view showing an external appearance of a refrigerator according to the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

Figure 2:
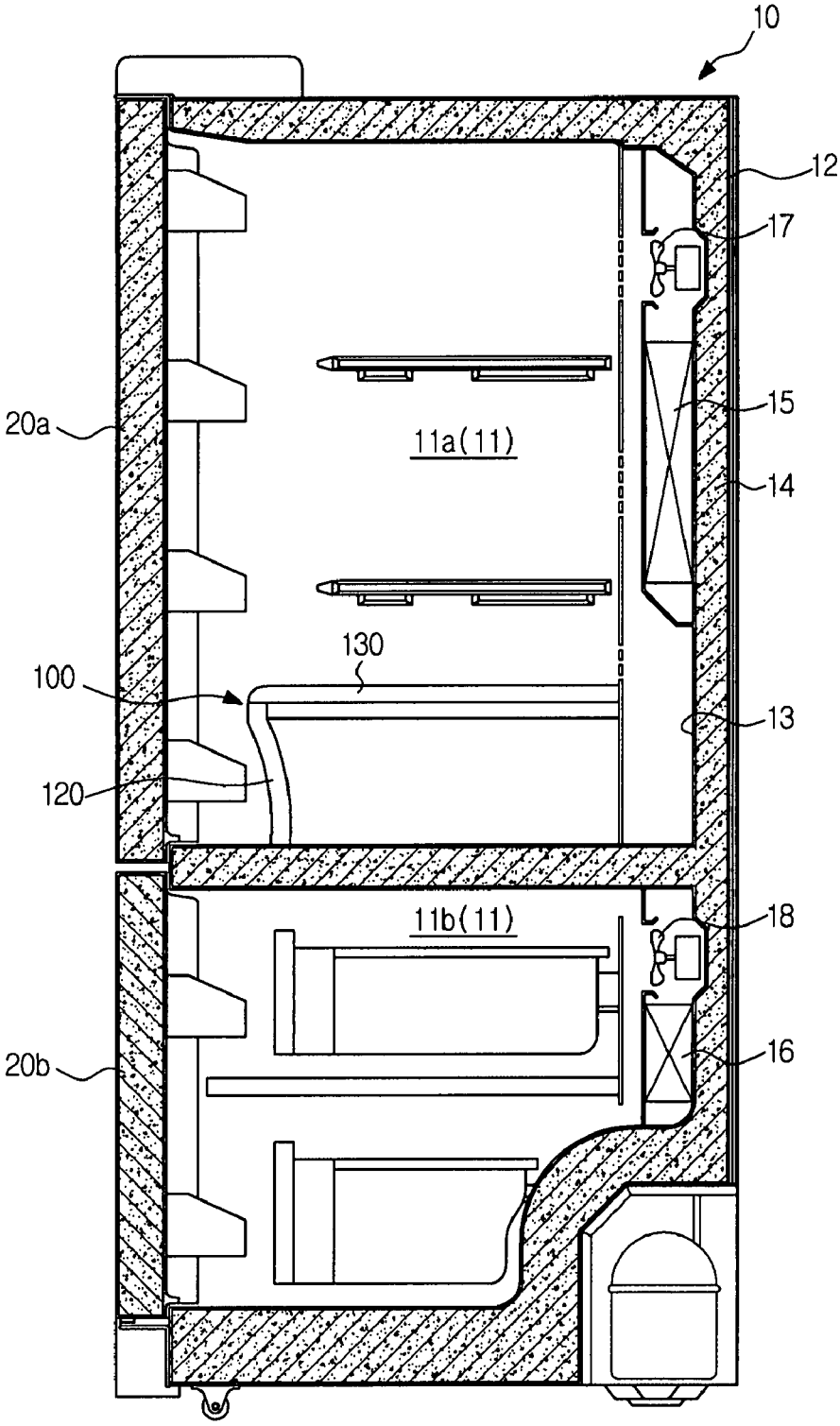
FIG. 2 is a cross-sectional view showing a configuration of the refrigerator according to the present invention.

Hereinafter, an embodiment of the present invention will be described in detail with reference to the accompanying drawings. FIG. 1 is a front view showing an external appearance of a refrigerator according to the present invention. FIG. 2 is a cross-sectional view showing a configuration of the refrigerator according to the present invention.

As shown in FIGS. 1 and 2, the refrigerator according to the present invention includes a main body 10 having a storage chamber 11 which stores food products, a door 20 which opens and closes the storage chamber 11, and a drawer type receiving device 100 which forms a separated storage space to freshly store food products such as vegetables and fruit without being dried.

The main body 10 includes an outer housing 12 which forms an outer surface of the main body 10, and an inner housing 13 which is disposed at a specified distance from the outer housing 12 to form the storage chamber 11 therein. Between the outer housing 12 and the inner housing 13 a thermal insulator 14 is formed by foaming to prevent cool air from dissipating.

The storage chamber 11 is divided into an upper portion and a lower portion by a middle partition, thereby forming a cooling chamber 11*a* which cools and stores food products at the upper side and a freezing chamber 11*b* which freezes and stores food products at the lower side. A pair of cooling chamber doors 20*a* rotates while being hinge-connected to the main body 10 to open and close the cooling chamber 11*a*. A freezing chamber door 20*b* is slidably installed on the main body 10 and moves forward and backward to open and close the freezing chamber 11*b*.

Evaporators 15 and 16 are installed at the rear of the storage chamber 11 to generate cool air to be supplied to the storage chamber 11 by heat exchange with surrounding air. Circulation fans 17 and 18 are respectively installed adjacent to the evaporators 15 and 16 to circulate air in the storage chamber 11.

Figure 3:
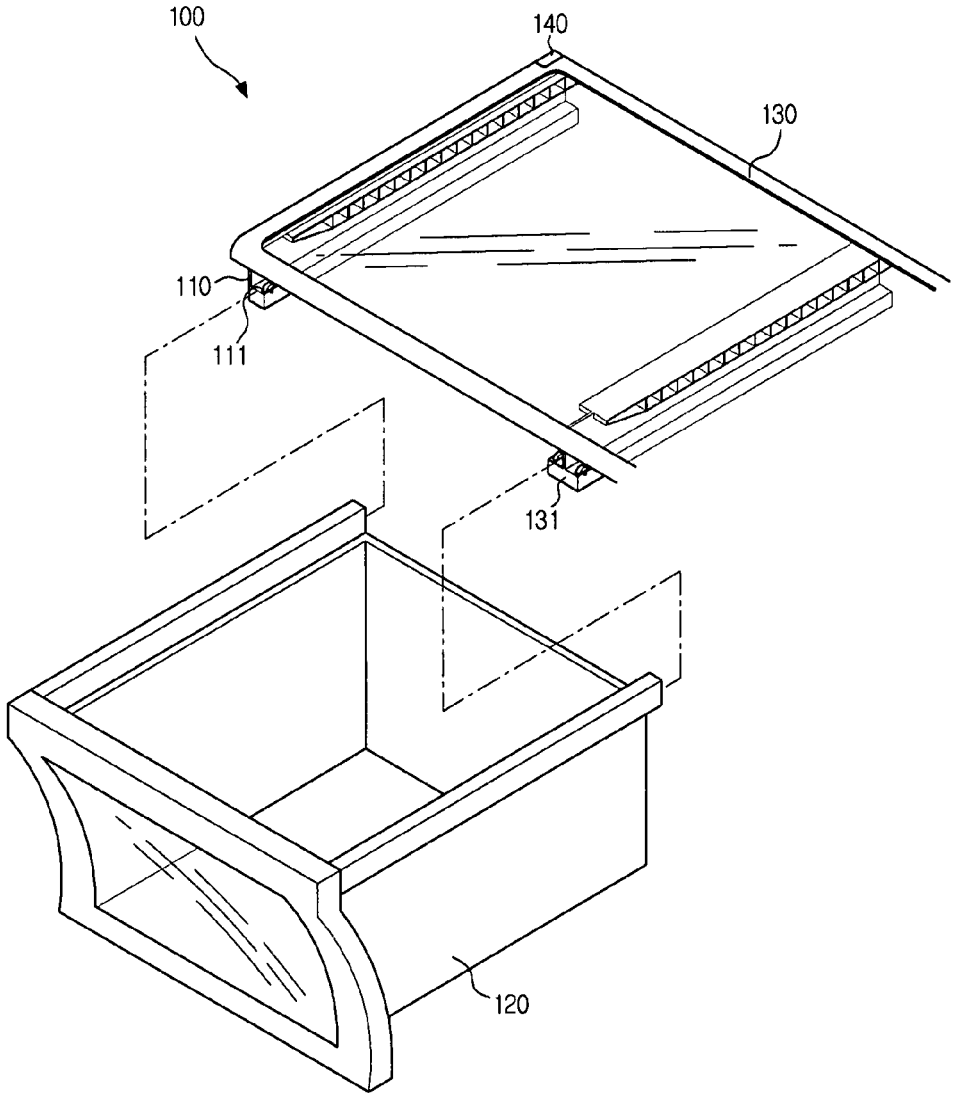
FIG. 3 is a perspective view showing a configuration of a receiving device in the refrigerator according to the present invention.
Figure 4:
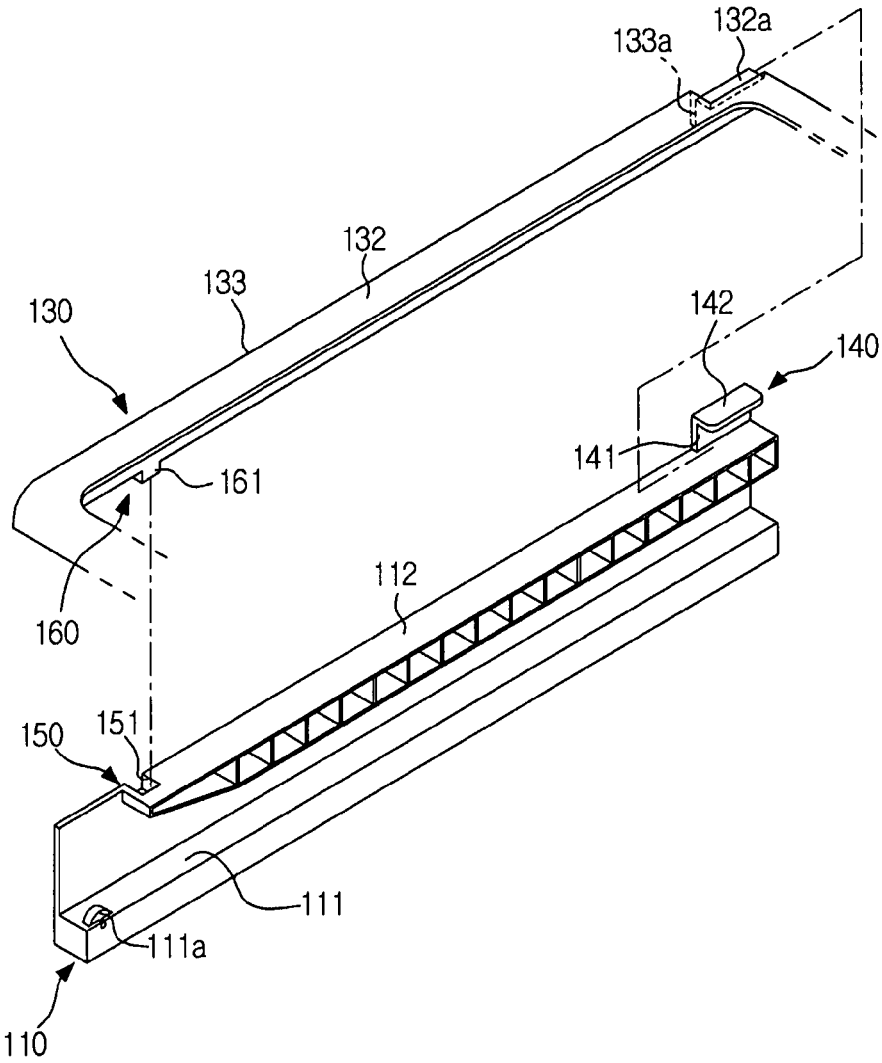
FIG. 4 is an exploded perspective view showing installation of a shelf onto a support member of FIG. 3.

FIG. 3 is a perspective view showing a configuration of the receiving device in the refrigerator according to the present invention. FIG. 4 is an exploded perspective view showing installation of a shelf onto a support member of FIG. 3. Since the receiving device has a symmetrical structure, FIGS. 3 and 4 show only one side portion for simplicity.

As shown in FIGS. 3 and 4, the receiving device 100 includes support members 110 respectively installed on the opposite side surfaces of the cooling chamber 11*a*, receiving containers 120 with upper portions opened to load and unload food products, and a shelf 130 which covers the upper portions of the receiving containers 120 to separate inner portions of the receiving containers 120 from the storage chamber 11. Although the receiving device 100 shown in FIG. 1 is installed in the cooling chamber 11*a* and has two receiving containers 120 arranged on the left and right sides, an installation position of the receiving device 100 and the number of the receiving containers 120 may be appropriately changed as required by the design without being limited thereto.

Each of the support members 110 includes a rail part 111 protruded toward the inside of the cooling chamber 11*a* such that each of the receiving containers 120 is slidably installed on the rail part 111 and a support surface 112 disposed at a specified distance above the rail part 111. The rail part 111 guides the sliding movement of the receiving container 120 when the receiving container 120 is extracted and retracted while supporting one side of the receiving container 120. A guide roller 111*a* is installed on the rail part 111 to smoothly move the receiving container 120. Meanwhile, as shown in FIG. 3, the shelf 130 has a guide rail 131 disposed between the two receiving containers 120. The guide rail 131 guides the extraction and retraction of the receiving container 120 together with the rail part 111 while supporting the other side of the receiving container 120.

As shown in FIG. 4, the shelf 130 is loaded on the support surface 112 of the support member 110. The support member 110 has a first restriction portion 140 and a second restriction portion 150 such that the shelf 130 is stably mounted on the support member 110. An engaging portion 160 is disposed on the shelf 130 to engage with the second restriction portion 150. The first restriction portion 140 restricts an upper surface 132 of the shelf 130 to prevent the vertical movement of the shelf 130. The second restriction portion 150 restricts the engaging portion 160 of the shelf 130 to prevent the forward-backward and left-right movement of the shelf 130. In this case, the first restriction portion 140 is positioned to restrict a rear portion of the shelf 130 and the engaging portion 160 and the second restriction portion 150 are positioned to restrict a front portion of the shelf 130.

The first restriction portion 140 is formed to cover a portion of a side surface 133 and a portion of the upper surface 132 of the shelf 130. For this, the first restriction portion 140 has an extended portion 141 extended upward from the support surface 112 of the support member 110 and a bent portion 142 bent toward the upper surface 132 of the shelf 130 from the extended portion 141. A stepped surface 132*a* is formed on the upper surface 132 of the shelf 130 to have a level difference to be fitted to a lower portion of the bent portion 142. A stepped surface 133*a* is formed on the side surface 133 of the shelf 130 to be fitted to an inner side portion of the extended portion 141. The stepped surfaces 132*a* and 133*a* may be formed in a rear edge portion of the shelf 130. As described above, the upper surface and the side surface of the shelf 130 have a step which is fitted to the first restriction portion 140, whereby the bent portion 142 and the extended portion 141 of the first restriction portion 140 are not protruded from the upper surface and the side surface of the shelf 130. Accordingly, the bent portion 142 of the first restriction portion 140 does not interfere with products positioned on the shelf 130. Further, it is possible to prevent a gap from being generated between the shelf 130 and the inner housing 13 (see FIG. 1) due to the extended portion 141 of the first restriction portion 140.

Figure 5:
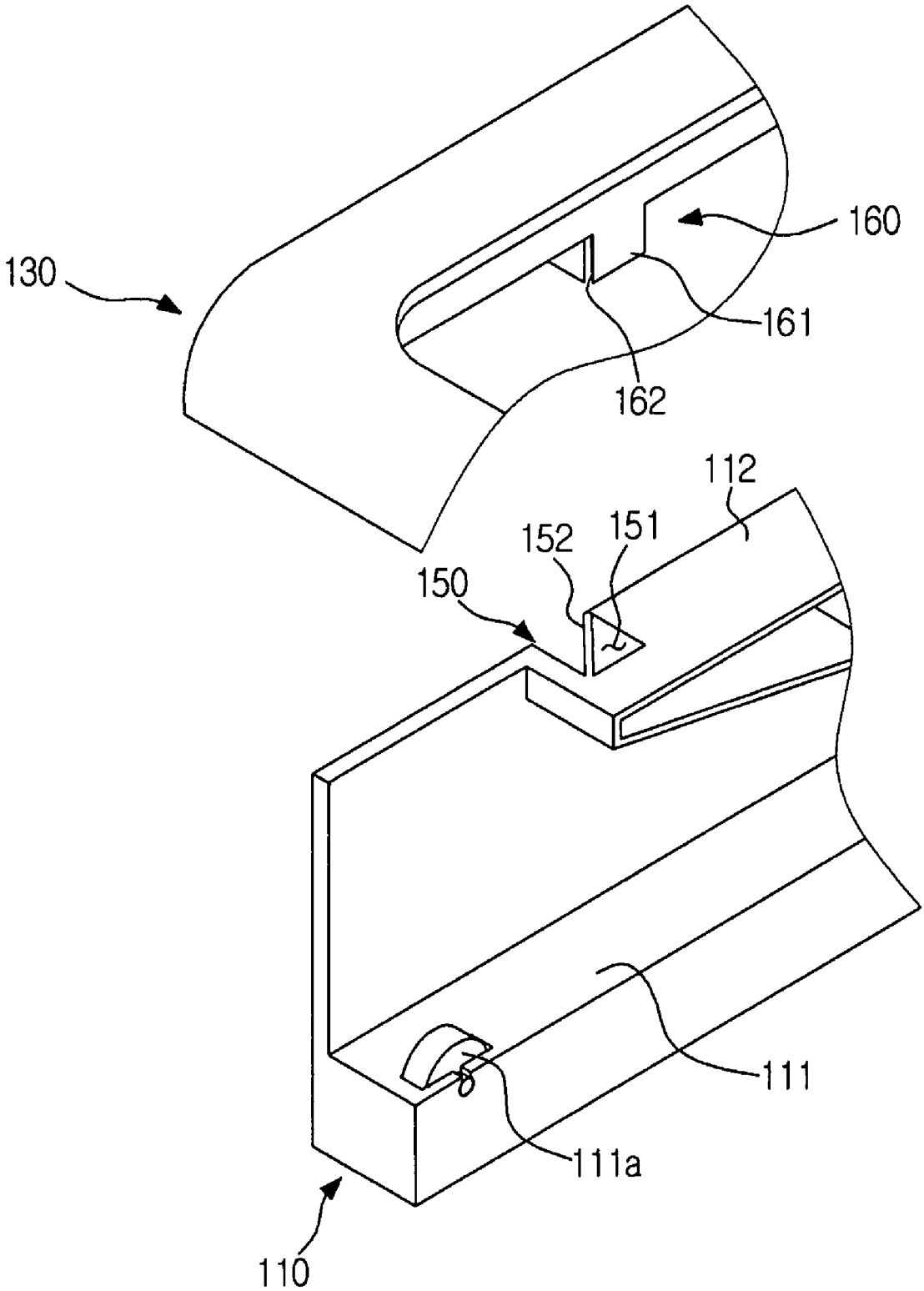
FIG. 5 shows an example in which a restriction rib is formed in a restriction groove according to the present invention.

The engaging portion 160 is formed on an outer frame of the shelf 130 as one body. The engaging portion 160 may be configured as an engaging protrusion 161 protruded from the lower surface of the shelf 130 toward the support surface 112 of the support member 110. Further, the second restriction portion 150 may be configured as a restriction groove 151 formed on the support surface 112 at a position corresponding to the engaging protrusion 161. In this case, the engaging protrusion 161 should be fully engaged with the restriction groove 151 to prevent the forward-backward and left-right movement of the shelf 130 to the maximum extent; if so, however, assembling efficiency of the shelf 130 is decreased. Accordingly, it is preferable that the engaging protrusion 161 is dimensioned to be slightly smaller than the restriction groove, so that the engaging protrusion may be loosely inserted into the restriction groove 151. Further, as shown in FIG. 5, an additional restrictor may be provided.

Specifically, the second restriction portion 150 may have a restriction rib 152 crossing the restriction groove 151. Although one restriction rib 152 crosses the restriction groove 151 in a diagonal direction in an example shown in FIG. 5, the second restriction portion 150 may have two restriction ribs, that is, a restriction rib crossing the restriction groove 151 in a left-right direction to prevent the forward-backward movement and a restriction rib crossing the restriction groove 151 in a forward-backward direction to prevent the left-right movement. Meanwhile, the engaging portion 160 of the shelf 130 has an engaging groove 162 corresponding to the restriction rib 152 to engage with the restriction rib 152.

Hereinafter, an operation for installing the shelf on the support member in the present invention will be described with reference to FIG. 4. First, the support members 110 are fixed to the opposite side surfaces of the cooling chamber 11*a* using fastening members such as screws. Then, the rear edge portions of the shelf 130, that is, the stepped surfaces 132*a* and 133*a* disposed at the opposite sides are inserted and fitted to the lower portions of the bent portions 142. Accordingly, the upper surface of the shelf 130 is restricted by the bent portions 142 to suppress the vertical movement of the shelf 130. In this state, the engaging protrusions 161 are inserted into the restriction grooves 151. Accordingly, the shelf 130 is stably loaded on the support surfaces 112 of the support members 110 to suppress the forward-backward and left-right movement of the shelf 130. Meanwhile, when the shelf 130 is separated, a front surface portion of the shelf 130 is slightly lifted up to separate the engaging protrusions 161 from the restriction grooves 151. Then, the shelf 130 is drawn forward to be extracted.

Although the first restriction portion 140 and the support member 110 are configured as one body in this embodiment, the first restriction portion 140 may be separated from the support member 110. For example, the first restriction portion 140 and the inner housing 13 may be configured as one body.

As described above, according to the present invention, the forward-backward and left-right movement of the shelf is suppressed by the restriction portion which restricts the rear portion of the shelf and the restriction portion which restricts the engaging portion disposed on the shelf. Accordingly, the shelf is stably supported in the storage chamber. Thus, unexpected movement or separation of the shelf is prevented, thereby providing reliability to the user.

Further, according to the present invention, the shelf can be easily assembled or separated, thereby improving user convenience.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A refrigerator comprising:

a storage chamber;

a support member fixed to each side wall of the storage chamber;

a shelf coupled to the support member while covering a receiving container arranged beneath the shelf; and a self fixing structure to separably fix the shelf to the support member, wherein the support member includes a support surface to support the shelf, and a rail part formed beneath the support surface while being integral with the support surface, to support the receiving container such that the receiving container is slidable in a forward-backward direction, wherein the self fixing structure includes a stepped surface formed at a rear edge portion of the shelf such that the stepped surface is downwardly stepped from an upper surface of the shelf, a restriction portion formed at the support member such that the restriction portion is engaged with the stepped surface, an engaging protrusion formed at a front portion of one of the shelf and the support member, and a restriction groove formed at the other one of the shelf and the support member such that the engaging protrusion is fitted into the restriction groove, and wherein the restriction portion includes an extended portion extended upward from the support surface of the support member, and a bent portion bent from the extended portion to cover the stepped surface of the shelf.

2. The refrigerator according to claim 1, wherein the stepped surface is laterally inwardly stepped from a side surface of the shelf to form a step having the same height as the extended portion.

3. The refrigerator according to claim 1, wherein the bent portion is flush with the upper surface of the shelf in a state in which the shelf is supported by the support member.

4. The refrigerator according to claim 1, wherein the engaging protrusion is downwardly extended from the side surface of the shelf.

5. The refrigerator according to claim 1, wherein the restriction portion is formed integrally with the support member.

6. The refrigerator according to claim 1, wherein the restriction groove is provided with a restriction rib extended across the restriction groove, and the engaging protrusion is provided with an engaging groove, in which the restriction rib is engaged.

7. The refrigerator according to claim 3, wherein the bent portion has a lower surface having the same shape as the stepped surface, and an upper surface having the same shape as the upper surface of the shelf.

8. The refrigerator according to claim 7, wherein the stepped surface is formed at the upper surface of the shelf, and the engaging protrusion is formed at a lower surface of the shelf.

9. A refrigerator comprising a storage chamber, a shelf installed in the storage chamber, a support member fixed to each side wall of the storage chamber, to support the shelf, and a self fixing structure to fix the shelf to the support member, wherein:

the self fixing structure includes an engaging protrusion formed at a front portion of one of the shelf and the support member, and a restriction groove formed at the other one of the shelf and the support member at a position corresponding to the engaging protrusion, to restrict the engaging protrusion, a stepped surface formed at an upper surface of a rear portion of the shelf, and a restriction portion formed on the support member at a position corresponding to the stepped surface, to restrict the stepped surface; and the restriction portion is seated on the stepped surface such that the restriction portion is not protruded from the upper surface of the shelf in a state in which the restriction portion is engaged with the stepped surface of the shelf.

10. The refrigerator according to claim 9, wherein the support member includes a support surface extended in a forward-backward direction along the side wall of the storage chamber, and a rail part formed beneath the support surface while being integral with the support surface such that the rail part is extended in the forward-backward direction, to support the receiving container.

11. The refrigerator according to claim 9, wherein the restriction portion includes an extended portion extended upward from the support surface, and a bent portion bent from the extended portion toward a center of the shelf.

12. The refrigerator according to claim 9, where the stepped surface of the shelf includes a first stepped surface laterally inwardly stepped from the side wall of the shelf, and a second stepped surface downwardly stepped from the upper surface of the shelf.

* * * * *